United States Patent [19]

Achmeteli

[11] 4,089,447

[45] May 16, 1978

[54] BACK PACK DEVICE

[76] Inventor: Hans Wano Achmeteli, 400 Sherwood Rd., Union, N.J. 07083

[21] Appl. No.: 812,999

[22] Filed: Jul. 5, 1977

[51] Int. Cl.[2] ..... A45F 3/10

[52] U.S. Cl. ..... 224/25 A; 224/5 P; 224/5 Q; 224/8 R

[58] Field of Search ..... 224/5 A, 5 B, 5 MA, 224/5 P, 5 W, 6, 8 R, 25 A, 26 R, 5 Q, 26 B, 26 G; 2/2, 44

[56] References Cited

U.S. PATENT DOCUMENTS

| | | | |
|---|---|---|---|
| 2,554,340 | 5/1951 | Maxwell | 224/6 |
| 3,114,486 | 12/1963 | Flexman | 224/8 R |
| 3,679,108 | 7/1972 | Ingram | 224/8 R |
| 3,957,183 | 5/1976 | Gadberry | 224/5 W |

FOREIGN PATENT DOCUMENTS

| | | | |
|---|---|---|---|
| 125,823 | 10/1945 | Sweden | 224/8 R |

*Primary Examiner*—Trygve M. Blix
*Assistant Examiner*—Winston H. Douglas
*Attorney, Agent, or Firm*—Martha G. Pugh

[57] ABSTRACT

A resilient back pack supporting member for carrying loads, particularly for hikers or mountaineers. The resilient supporting member is triangular in cross-section, with the thinner top portion designed to contact the shoulders and the thicker bottom portion designed to contact the lower back of the wearer. The support is fastened to the back by conventional shoulder straps, with the load strapped or otherwise secured to the external rear surface. In one embodiment, the support may be formed of a single triangular slab of foam rubber or the like, covered with a cloth skin. In another embodiment, the interior of the supporting member is stuffed with chips or small pieces of foam rubber or the like. In a third embodiment, the skin is a gas impervious bag which is pumped full of air or oxygen through conventional valve means.

12 Claims, 8 Drawing Figures

BACK PACK DEVICE

BACKGROUND OF THE INVENTION

This invention relates to back pack equipment for carrying loads, more particularly, of a type useful to hikers and mountaineers.

In the prior art, back packs, or rucksacks as they are called, supported by shoulder straps on the back of the wearer, providing containers for carrying clothing, food and equipment, are well known. With such an arrangement, the bulk of the load produces a large vertical component depending vertically from the shoulders of the hiker, tending to tire him and to distort his posture. Furthermore, if the load in the pack comprises bulky solids, such as canned goods, or tools and other equipment, it tends to rest uncomfortably against the hollow of the back, bumping against the lower back as it is transported. Furthermore, this discomfort is aggravated for alpine climbers who must necessarily carry oxygen in addition to their usual loads.

SUMMARY OF THE INVENTION

It is, therefore, the principal object of the present invention to provide an improved type of back pack which will apparently lighten and more comfortably position the load to be carried on the back of a hiker or mountaineer. Another object of the invention is to provide means for carrying oxygen for high altitude climbing, which serves a dual purpose of partially supporting the load on the climber's back during transport.

These and other objects of the invention are realized in a back pack comprising a cushion-like supporting member having a completely closed skin or cover and a resilient interior. The inner face of the resilient supporting member, which is designed to be in contact with the back of the wearer, is substantially flat and rectangular, and is equipped with a pair of adjustable straps designed to fit over the shoulders of the wearer in conventional fashion. The cross-sectional shape of the resilient supporting member, in a plane substantially normal to its major faces, is in the form of a right angle triangle, having its acute apex angle adjacent the shoulder portion, so that its external rear face lies in the plane of the hypothenuse. Rings, straps or other connecting means are secured to the external rear face of the resilient supporting member so that the load is readily strapped or roped on the surface. Thus, the position of the load on the back of the wearer is such that the weight component in a vertical plane depending from the shoulders is substantially reduced, making the load seem lighter to the person carrying it. Furthermore, contact between the load and the lower back of the wearer is cushioned so as to reduce contact and make the pack more comfortable to wear.

Three specific embodiments of the invention are disclosed. In accordance with one embodiment, the resilient interior of the supporting member may take the form of a triangular slab of natural or synthetic rubber or plastic foam encased in a rugged skin, which may be plastic, natural or synthetic rubber or any cloth formed of natural and/or synthetic fibers, such as denim or a knitted material, including nylon tricot, or any suitable material with good wearing and nonshrinking qualities which will fit tightly over the interior slab, and which is not toxic in contact with the skin.

In a second embodiment, the single triangular interior slab may be replaced by chips, wads or small irregular bits or pieces of plastic foam or other light fibrous material encased in a skin similar to that described with reference to the first embodiment.

A third embodiment is particularly adapted for use by alpine climbers. In this embodiment, the resilient supporting member, which has a shape similar to that disclosed in the other two embodiments, takes the form of a completely closed container having a skin of gas impervious material, such as natural or synthetic rubber, which is pumped full of air or oxygen under pressure through a conventional valve, preferably located on or near the base of one of the triangular ends, so that the valve does not come in contact with either the back of the wearer or the load.

A particular feature of the resilient supporting member of the present invention is that when it is mounted on the back of the wearer, standing upright, and the load is strapped or otherwise fastened to its external rear surface, it substantially reduces the component of weight depending vertically from the shoulders. Exactly how much this vertical component of the load is actually reduced will depend on the specific dimensions of triangular cross-section of the resilient supporting member.

A further advantage is to be realized by using an embodiment of the third type, which permits an alpine climber to carry a supply of oxygen in the interior of the resilient supporting member, which also serves to cushion the backload during climbing. At the appropriate time, the oxygen may be extracted and used for breathing, and may be replaced by ordinary air in the resilient supporting member, such as by operation of a hand pump.

These and other objects, features and advantages of the invention will be apparent to those skilled in the art upon studying the detailed description hereinafter with reference to the accompanying drawings.

DETAILED DESCRIPTION

Figure 1:
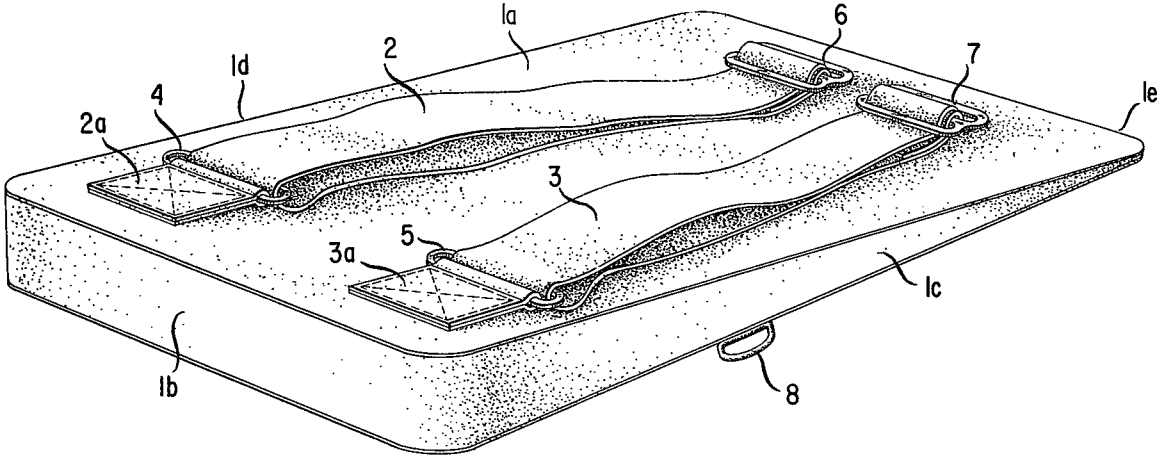
FIG. 1 is a perspective showing of the resilient back pack supporting member of the present invention resting on its external rear face.

Referring now to FIG. 1 of the drawings, there is shown, in perspective, a resilient supporting member 1 in accordance with the present invention, lying on its external rear surface. A side elevational view, a view looking down from the top, and a perspective view with the external rear surface designed to support the load, directed face up, are shown in FIGS. 2, 3 and 4, respectively.

The forward surface 1*a*, designed to be in contact with the back of the wearer, is rectangular. The external rear surface 1*f* is also rectangular.

Figure 2:
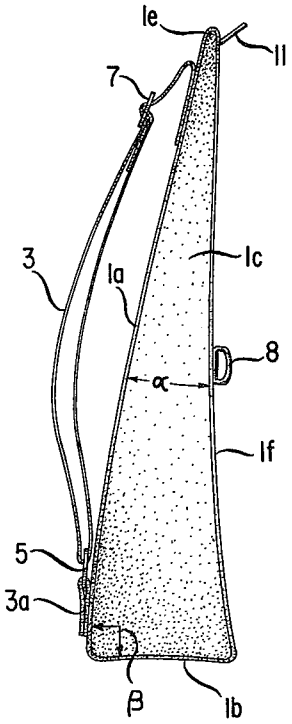
FIG. 2 is a side elevation of the resilient back pack supporting member of the present invention in upright position, ready to be mounted on the back of the carrier.

From FIG. 2 it can be seen that the external rear surface 1*f* is designed in the plane of the drawing at an acute angle $\alpha$, of, say, 25° to 30° to the forward surface 1*a*. The bottom surface 1*b* forms, in the same plane, an angle $\beta$ with the forward surface 1*a*, which may be approximately a right angle. In the present illustrative example, the rectangular forward surface 1*a* may be, say, 16 to 20 inches (40.6 cm. to 50.8 cm.) long and 10 to 12 inches (25.4 cm. to 30.5 cm.) wide; and the external rear surface 1*f* may also be approximately 16 to 20 inches (40.6 cm. to 50.8 cm.) long and 10 to 12 inches (25.4 cm. to 30.5 cm.) wide. The base surface 1*b* may be, say, 10 to 12 inches (25.4 cm. to 30.5 cm.) wide and 10 to 12 inches (25.4 cm. to 30.5 cm.) long.

Figure 3:
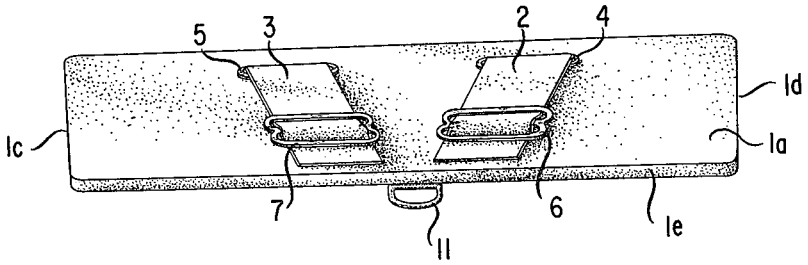
FIG. 3 is a view looking down from the top of the resilient back pack supporting member of FIG. 1.
Figure 4:
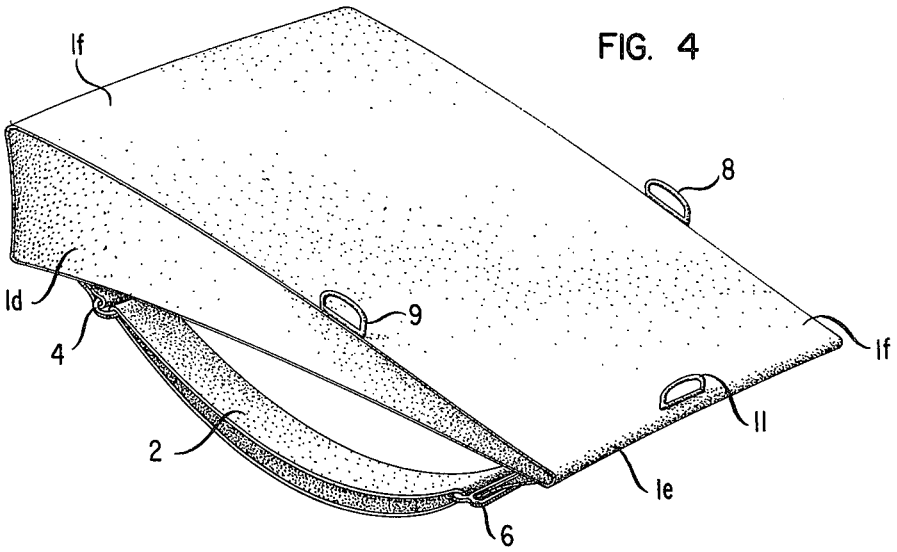
FIG. 4 is a perspective showing of the resilient back pack supporting member of FIG. 1 with the external rear face directed upward.

Attached lengthwise to the forward surface 1*a*, as shown in FIGS. 1, 2 and 3, are a pair of conventional shoulder straps 2 and 3, which may be, for example, 2 inches (5.08 cm.) wide and are spaced symmetrically in longitudinal parallel array about 5 inches (12.7 cm.) apart, and are each fastened about 1 inch (2.54 cm.) below the top and, say, 5 inches (12.7 cm.) above the lower end. These straps 2 and 3 may be formed of cloth or of whatever material the skin of support member 1 is formed. To make the straps adjustable in length, in the conventional manner, the straps 2 and 3 are respectively threaded through elliptical rings 4 and 5 at their lower ends and are fastened at their upper ends by means of conventional buckles 6 and 7.

Referring to FIG. 4, the three rings 8, 9 and 11 are respectively provided, near the centers of the long edges and near the center of the top, for strapping or tying the load onto the external rear surface 1*f*. It will be understood that in FIGS. 1, 2 and 4, although only one ring is shown on each side of the supporting member 1, for the purpose of illustration, the pack will be better secured to the supporting member by the use of three rings on each side, and additionally, two rings on the top and two rings on the bottom. Alternatively, straps can be sewed or otherwise fastened to the surface 1*f* in place of rings 8, 9 and 11.

Figure 5B:
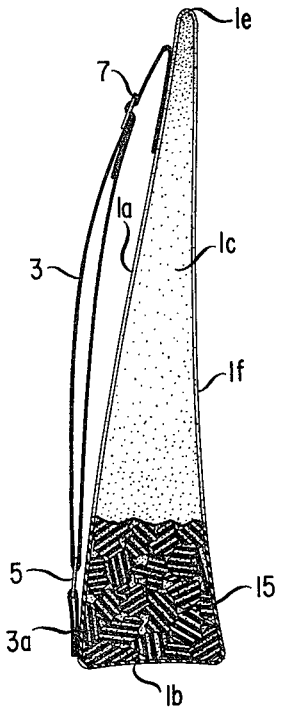
FIG. 5B shows a second embodiment of the resilient back pack supporting member of the present invention sectioned to show a cover stuffed with bits or chips of foam rubber.
Figure 5A:
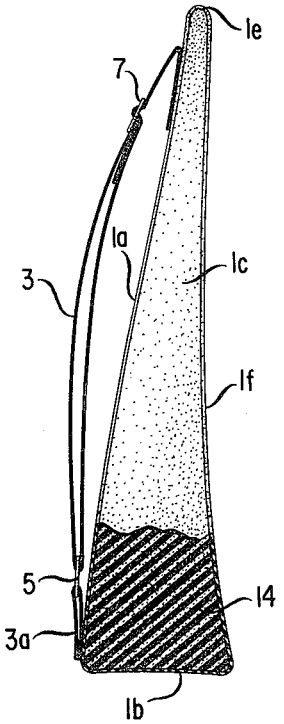
FIG. 5A shows one embodiment of the resilient back pack supporting member of the present invention sectioned to show a solid foam rubber interior.
Figure 5C:
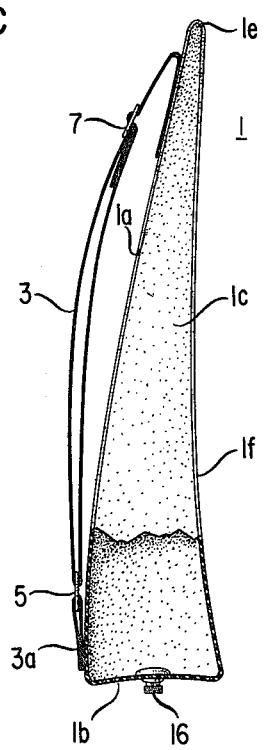
FIG. 5C shows a third embodiment of the resilient back pack supporting member of the present invention sectioned to show a natural or synthetic rubber bag filled with gas.
Figure 6:
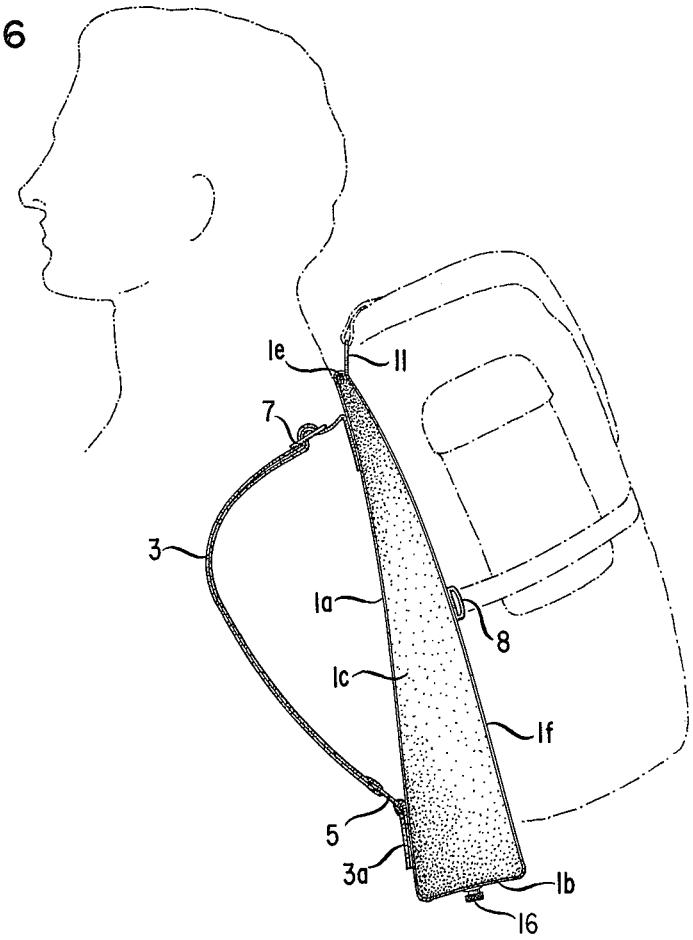
FIG. 6 shows a resilient back pack supporting member in accordance with the present invention mounted on the back of the wearer, with the load strapped to its external surface.

The FIGS. 5A, 5B and 5C respectively show three different embodiments of the invention.

The embodiment shown in FIG. 5A comprises as its interior a single slab of rubber or plastic foam 14, which may, for example, comprise foam of natural rubber, neoprene, butadiene acrylonitrile, butadiene styrene, polyurethane or like material. The slab 14 is covered by a tightly fitted skin which may be formed of any of the following: natural or synthetic rubber, plastic or cloth of any natural or synthetic fibrous material, such as, for example, denim, nylon tricot, or any material having a good wearing ability, which in nontoxic to the skin.

An alternative form is shown in FIG. 5B in which the slab 14 of natural or synthetic rubber foam is replaced inside of the enclosing skin by a stuffing of small chips or bits 15 of natural or synthetic rubber foam or like material, having a cross-sectional dimension not exceeding about ¾ inch (1.3 cm.). Alternatively, wads of natural or synthetic fibers can also be used for this purpose.

A third embodiment is disclosed in FIG. 5C in which the outer skin of the resilient support member 1 comprises a completely closed bag or container consisting of natural or synthetic rubber of any well-known type, or other gas impervious material. At or near the lower end on one side, the container comprising the resilient supporting member 1 is equipped with a valve 16 of one of the types conventionally used for tire inner tubes. Through the valve 16 the container 1 is pumped full of air or oxygen to a pressure of, say, 7 or 8 pounds per square inch above atmospheric pressure, at ambient temperature. Alpine climbers can fasten oxygen hoses to the valve 16 to draw out oxygen as needed at high altitudes. The supporting member 1 can later be pumped full of ordinary air by means of a small hand pump for the continued or return trip. In addition to serving as a source of oxygen for breathing purposes, the gas-filled supporting member 1 can also serve as a float in deep water, performing the function of a life preserver for back packers whose canoes or boats capsize.

It will be understood that the scope of the present invention is not to be construed as limited to the particular forms or dimensions which are stated in this specification by way of example, but only by the recitations of the claims hereinafter.

What is claimed is:

1. A separate back pack support for carrying a load on the back of a wearer which comprises in combination:

a resilient cushion-like body having a substantially planar forward major surface constructed for contact with the back of the wearer, and a substantially planar external rear major surface constructed to be secured to the load, said forward and rear major surfaces being disposed to one another at an acute angle of approximately 25° to 30° in a vertical plane normal to said surfaces whereby the cross-section of said body in said plane is substantially triangular, the narrow cross-sectional top portion of said body constructed to be in contact with the shoulders of the wearer, and the broad cross-sectional bottom portion of said body constructed to be in contact with the lower back of the wearer, shoulder straps connected to said forward major surface for securing said body to the shoulders of said wearer, and, means connected to said external rear major surface for securing said load to said external rear major surface.

2. A back pack support in accordance with claim 1 wherein said cushion-like body comprises a slab of natural or synthetic foam rubber enclosed in a tight fitting skin.

3. The combination in accordance with claim 2 wherein said enclosing skin consists essentially of cloth formed of natural or synthetic fibers.

4. The combination in accordance with claim 2 wherein said enclosing skin consists essentially of a sheet of natural or synthetic rubber.

5. A back pack support in accordance with claim 1 wherein said cushion-like body comprises an outer skin stuffed with bits or chips of natural or synthetic foam rubber, or wads of fibrous material.

6. The combination in accordance with claim 5 wherein said enclosing skin consists essentially of cloth of natural or synthetic fibers.

7. The combination in accordance with claim 5 wherein said enclosing skin consists essentially of a sheet of natural or synthetic rubber.

8. A back pack support in accordance with claim 1 wherein said cushion-like body comprises a gas impervious outer skin closed except for a valve.

9. The combination in accordance with claim 8 wherein said body is filled with gas to a pressure substantially above atmospheric pressure.

10. The combination in accordance with claim 9 wherein said body is filled with gas at ambient temperature to a pressure of at least about 7 pounds per square inch above atmospheric pressure.

11. The combination in accordance with claim 9 wherein said gas consists essentially of oxygen suitable for breathing.

12. The combination in accordance with claim 8 wherein said gas impervious outer skin consists essentially of a sheet of natural or synthetic rubber.

* * * * *